United States Patent [19]

Hazard

[11] 3,967,764

[45] July 6, 1976

[54] CHILD-RESISTANT CLOSURES WITH LIMITED SPOUT ACCESSIBILITY

[75] Inventor: Robert E. Hazard, North Kingstown, R.I.

[73] Assignee: Polytop Corporation, Slatersville, R.I.

[22] Filed: Dec. 2, 1974

[21] Appl. No.: 528,652

Related U.S. Application Data

[63] Continuation-in-part of Ser. No. 326,425, Jan. 24, 1973, Pat. No. 3,851,805.

[52] U.S. Cl. ..... 222/536

[51] Int. Cl.[2] ..... B65D 25/46; B65D 47/06

[58] Field of Search ..... 222/534, 536

[56] References Cited

UNITED STATES PATENTS

| | | | |
|---|---|---|---|
| 2,800,259 | 7/1957 | Wilson et al. | 222/534 |
| 3,023,939 | 3/1962 | Gustafson | 222/536 |
| 3,490,659 | 1/1970 | La Vange et al. | 222/534 |
| 3,718,238 | 2/1973 | Hazard et al. | 222/536 |

*Primary Examiner*—Robert B. Reeves
*Assistant Examiner*—Frederick R. Handren
*Attorney, Agent, or Firm*—Edward D. O'Brian

[57] ABSTRACT

A dispensing closure having a cap adapted to be secured to a container so that it is substantially impossible to remove the cap from the container and having a spout rotatably mounted on the cap so as to be capable of being rotated between a closed position in which the spout covers an opening through the cap and an opened position in which the spout is in alignment with the opening can be easily modified so as to render the closure child resistant in character. The modification involves shaping the cap and the spout so that only the tip of the spout can be engaged to rotate the spout when the spout is in the closed position. The modification also involves forming a wall structure on the cap so as to define a slot, this slot being positioned so that the tip of the spout fits within it and is spaced from the bottom of the slot when the spout is in the closed position. The slot and the tip are dimensioned so that the tip cannot be directly engaged by a part of the hand of a user such as a finger, a thumbnail or the like so as to rotate the spout. The slot and the tip are also dimensioned so that a small coin can be inserted into the slot beneath the tip to rotate the spout from the closed position.

1 Claim, 4 Drawing Figures

CHILD-RESISTANT CLOSURES WITH LIMITED SPOUT ACCESSIBILITY

CROSS REFERENCE TO RELATED PATENTS

This application is a continuation in part of the co-pending U.S. Patent application 326,425 filed Jan. 24, 1973, entitled "Child-Resistant Closures With Limited Spout Accessibility" which issued as U.S. Pat. No. 3,851,805 on Dec. 3, 1974. The entire disclosure of this co-pending application is incorporated herein by reference.

BACKGROUND OF THE INVENTION

The invention set forth herein pertains to new and improved child resistant dispensing closures.

The term "dispensing closures" as employed in this specification is intended to designate a structure which is used to close off an entrance opening into a container, such a structure having a cap which is adapted to be secured to the container and having a spout rotatably mounted on the cap so as to be capable of being rotated between opened and closed positions relative to an opening extending through the cap. On rare occasions such closures are formed so that what is referred to herein as a cap is integral with the container. These dispensing closures may be constructed in a number of different ways. Thus, for example, the spouts in them may be rotatably mounted in different manners and these closures may have a variety of different shapes.

The term "child-resistant" as used herein is intended to indicate a structure which is of such a character that it is not apt to be actuated or otherwise used by a comparatively young child. Thus, as this term is applied in the dispensing closure industry it is intended to designate closures which are sufficiently difficult to open that there is only a limited chance of a child being able to open them. Child-resistant closures are considered desirable for many uses because they minimize the chances of a child gaining access to a dangerous or hazardous material.

Many different child-resistant closures have been proposed in the appropriate technical and patent literature. Certain of such closures have been employed commercially. An understanding of the present invention does not require a detailed consideration of the vast majority of such prior child-resistant closures. It does, however, require a consideration of the most pertinent of such prior structures.

This pertinent structure is disclosed in the U.S. Pat. No. 3,851,805. Closures as shown in this patent are constructed in such a manner that a pencil or similar instrument may be inserted beneath the tip of a rotatable spout so as to lift the spout from a position of limited accessibility to a position in which the spout may be manually engaged so that is can thereafter be rotated by manual engagement from an initial closed position to an opened position. Closures of this type are constructed so that in the closed position the tip of the spout is located in what in effect is a notch constructed in such a manner as to permit the implement to be inserted from a side of the spout more or less at a right angle to the spout.

While structures employing this mode of operation are utilitarian and effective, several problems are encountered in connection with them. If a common pencil is used to open the spout the lead of such a pencil may be broken off by contact with the spout. Further, such a pencil may leave a deposit of lead on the spout or within the wall structure defining the notch. If a ball-point pen is used to open the spout there is danger of such a pen similarly depositing the marking fluid used in the pen. Normally other implements suitable for use in opening the spout are not conveniently available.

As a consequence of this it is considered that closures as set forth in this patent are somewhat disadvantageous even though they are desirable and utilitarian.

As a consequence of these factors it is considered that there is a need for improvement in child-resistant dispensing closures of the type indicated in the aforenoted patent. More specifically, it is considered that there is need for closures as set forth in this patent which are capable of being easily and conveniently opened by an individual, which will not "pick up" a marking composition or fluid as they are used, which will not damage an implement used to open such closures, and which can be opened by virtually any normal adult at any time utilizing a common coin as an implement or a means for opening such closures.

BRIEF SUMMARY OF THE INVENTION

A broad objective of such an invention is to provide new and improved child-resistant dispensing closures. A related object of the invention is to provide such closures which meet the need or needs indicated in the preceding discussion. Another object of the present invention is to provide closures as described which retain all of the advantages of closures as set forth in the above noted U.S. Pat. No. 3,851,805, but which are more desirable than the closures indicated in this patent.

The noted objectives of the invention are achieved in a dispensing closure having a cap adapted to be secured to a container so that it is substantially impossible to remove the cap from the container and having a spout rotatably mounted on the cap so as to be capable of being rotated between a closed position in which the spout covers an opening through the cap and an opened position in which the spout is in alignment with the opening by the improvement which comprises: the cap and spout being shaped so that only the tip of the spout can be engaged to rotate the spout when the spout is in the closed position, the cap including a wall structure defining a slot, the tip of the spout fitting within and being spaced from the bottom of the slot when the spout is in the closed position, the slot and the tip being dimensioned so that the tip cannot be directly engaged by a part of the hand of the user so as to rotate the spout, the tip and the slot being of such dimension that a coin can be inserted into the slot underneath the tip to rotate the spout from the closed position.

The invention is best more fully described with reference to the accompanying drawing in which.

Figure 1:
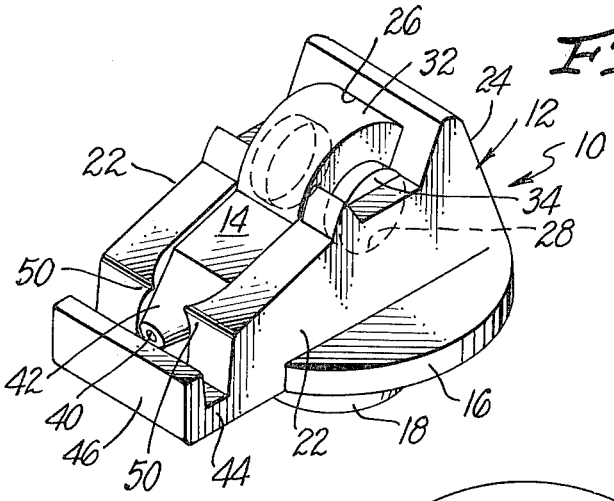
FIG. 1 is an isometric view of a presently preferred child-resistant dispensing closure constructed in accordance with the claimed concepts of the invention.
Figure 2:
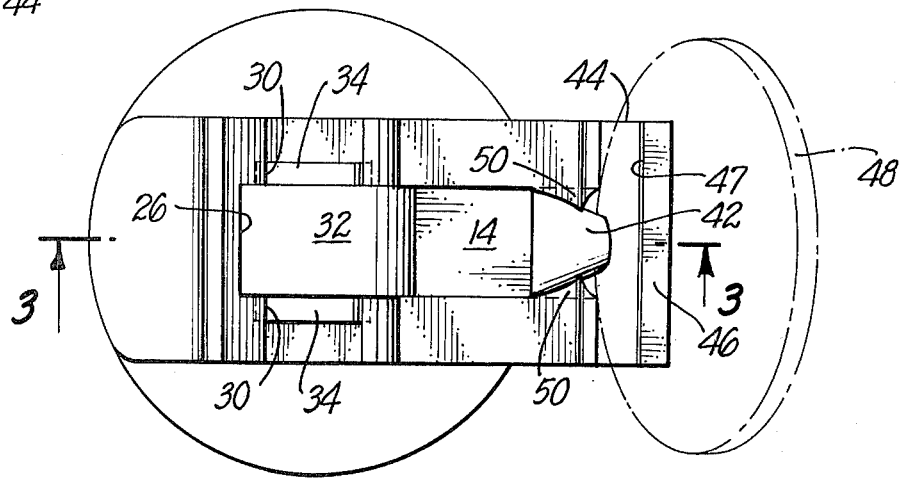
FIG. 2 is a top plan view of the closure shown in FIG. 1.
Figure 3:
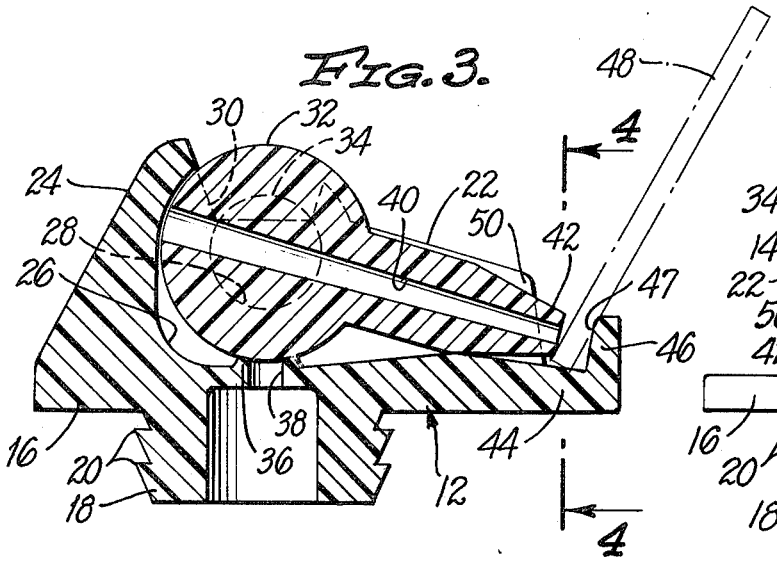
FIG. 3 is a cross-sectional view taken at line 3—3 of FIG. 2.
Figure 4:
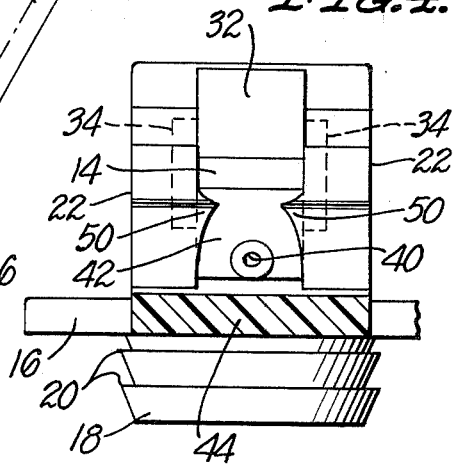
FIG. 4 is a cross-sectional view taken at line 4—4 of FIG. 3.

The particular closure 10 illustrated in FIG. 1 to 4 of the drawing is constructed so as to include a cap 12 and a spout 14. This cap 12 and spout 14 are preferably both constructed of a polymer material such as linear polyethylene or the like so that they can be conveniently assembled by being popped together in accordance with what is now conventional practice in the dispensing closure industry. The cap 12 is conventional to the extent that it includes a base 16 having a dependent cylindrical sleeve 18 provided with external ridges 20. This sleeve 18 is constructed in the manner shown so that it may be forced through an opening in a container (not shown) such as a metal can to a sufficient extent so that the base 16 rests against the surface of such a container. The ridges 20 are intended to engage such a container adjacent to and around the opening in such a manner as to mount the cap 12 so that it is substantially impossible for a user to normally remove the closure 10 from such a container.

The particular cap 12 illustrated includes two substantially parallel walls 22 which are located so as to be upstanding on the base 16. These walls 22 are connected by a back wall 24. The adjacent surfaces of the walls 22 and 24 are shaped so as to define a part of a cavity 26 and so as to define aligned bearing openings 28 located in the side walls 22 in axial alignment. These bearing openings 28 terminate in restricted entrances 30 of lesser width than the diameter of the bearing openings 28.

The structure of the walls 22 and 24 is designed so that a generaly cylindrical base or center member 32 on the spout 14 may be located within the cavity 26 by aligned trunions or axles 34 on the base 32 being held in the bearing openings 28. When the spout 14 is so held the base 32 engages and slightly deforms a resilient sealing ring 36 located around an opening 38 extending through the base 16 into the interior of the sleeve 18. When the spout 14 is in a closed position as indicated in FIGS. 1 to 4 this base 32 closes off or seals this opening 38.

The spout 14 is, however, capable of being engaged so as to be rotated to a position in which a passage 40 extending through the spout 14 from the base 32 to a pointed tip 42 of the spout 14 is in alignment with this opening 38. Normally the back wall 24 will be formed as shown as to serve as a stop limiting rotation of the spout 14 so that when the spout 14 is in substantially vertical position the opening 38 and the passage 40 will be in alignment.

In accordance with this invention the walls 22 and 24 and the spout 14 are formed so that it is substantially impossible to engage the spout 14 at other than the tip 42 in order to rotate the spout 14 from a closed position. It will be noted that with the closure 10 that the base 32 is to a degree exposed when the spout 14 is in such a closed position. The portion of the base 32 exposed is so minor and the frictional resistance against rotation of the spout 14 is so great that normally it is impossible to engage the base 32 so as to rotate the spout 14. Such rotation is normally achieved through engagement of the tip 42. Because this tip 42 is spaced from the axis of rotation of the spout 14 a leverage advantage is achieved through engaging the tip 42 in rotating the spout 14.

With the present invention engagement of the tip 42 when the spout 14 is in the closed position as illustrated is restricted by the use of a wall structure comprising a bottom wall 44 and an end wall 46. The bottom wall 44 in effect constitutes an extension of the base 16. Normally this bottom wall 44 will lie against a container (not shown) when the closure 10 is used. When the bottom wall 44 is positioned in this manner it will be incapable of flexing so as to facilitate access to the tip 42. In some cases it may be desired to space the bottom wall 44 upwardly from the base 16 a slight amount so as to facilitate it flexing when the closure 10 is used. The end wall 46 is perpendicular to the bottom wall 44 and is approximately opposite the tip 42. This wall 46 is also spaced from the side walls 22 in the embodiment of the closure 10 illustrated. Preferably the end wall 46 is sufficiently thick so that it cannot be easily deformed away from the tip 42.

In effect, the walls 44 and 46 define a slot 47 opposite the tip 42. When the spout 14 is in the closed position the only way that this tip 42 can be engaged so as to rotate the spout 14 to an opened position is to insert an implement such as a coin 48 indicated in dotted lines in the drawing over the end wall 46. Such a coin 48 will be manipulated as it is used so as to engage the portion of the tip 42 closest adjacent to the bottom wall 44. As such a coin 48 is manipulated it can be utilized as a lever so as to gradually pry the tip 42 upwardly to a sufficient extent for the tip 42 to be manually engaged.

The spacing of the wall 46 is such that normally no part of the hand of the individual can reach around this wall 46 so as to engage the tip 42 in order to rotate the spout 14. Thus, with the closure 10 it is impossible to rotate the spout 14 from a closed position through the use of the fingers and/or normal fingernails. A number of different implements can of course be utilized as the coin 48 in opening the spout 14. During the use of such an implement the wall 46 may be temporarily deformed to a slight extent.

It is possible to increase the diffficulty of rotating the spout 14 in a number of different ways. One manner in which this can be accomplished is of course by restricting the spacing between the end wall 46 and the tip 42 when the spout 14 is in a closed position. Another way is by increasing the dimension of the walls 44 and 46 so as to make access to the tip 42 increasingly difficult. Expedients of this type are not considered overly desirable because they tend to detract from the ease with which an implement such as a coin may be used to open the spout 14 as described in the preceding.

A preferred way of restricting the rotation of the spout 14 is to utilize slightly overhanging shoulders 50 on the side walls 22. These shoulders overlie the tip 42 to a slight extent when the spout 14 is closed. When the spout 14 is being rotated between opened and closed positions the walls 22 in the structure shown will deflect slightly so as to permit passage of the tip 42 between the shoulders 50.

I claim:

1. A dispensing closure having a cap adapted to be secured to a container so that it is substantially impossible to remove the cap from the container and having a spout rotatably mounted on the cap so as to be capable of being rotated between a closed position in which the spout covers an opening through the cap and an opened position in which the spout is in alignment with the opening in which the improvement comprises:

said cap including a base, means on said base for mounting the cap on a container, two substantially parallel spaced walls extending upwardly from said base, said parallel walls having adjacent ends, a part of said base extending between and connecting said parallel walls, a back wall connecting two adjacent ends of said parallel walls, a bottom wall extending horizontally from said part of said base adjacent to and generally between said other adjacent ends of said parallel walls, said bottom wall constituting an extension of said part of said base between said parallel walls, an upstanding end wall located on said bottom wall and spaced from said second mentioned adjacent ends of said parallel walls.

said spout being rotatably mounted on said cap so as to extend in its closed position between said parallel walls above said part of said base with its tip extending beyond said second mentioned adjacent ends of said parallel walls and above said bottom wall with said tip being spaced from said end wall, said cap and said spout being shaped so that only said tip of said spout can be engaged to rotate said spout when said spout is in said closed position, said bottom wall, said end wall, said parallel walls and said spout being dimensioned so that said tip cannot be directly engaged by the digits of the hand of a user so as to rotate said spout from said closed position and being of such dimensions that an implement can be inserted downwardly between said tip and said end wall underneath said tip and manipulated as a lever against said end wall to rotate said spout upwardly from said closed position to a sufficient extent that said spout may be thereafter engaged by the digits of the hand of a user to rotate said spout to said opened position.

* * * * *